US010916182B2

(12) United States Patent
Alousi et al.

(10) Patent No.: US 10,916,182 B2
(45) Date of Patent: Feb. 9, 2021

(54) DISPLAY SCAN TIME COMPENSATION SYSTEMS AND METHODS

(71) Applicant: Apple Inc., Cupertino, CA (US)

(72) Inventors: Sinan Alousi, Campbell, CA (US); Haifeng Li, Campbell, CA (US); Mohammad Hajirostam, San Jose, CA (US); Yafei Bi, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 453 days.

(21) Appl. No.: 15/711,696

(22) Filed: Sep. 21, 2017

(65) Prior Publication Data

US 2018/0322823 A1 Nov. 8, 2018

Related U.S. Application Data

(60) Provisional application No. 62/500,930, filed on May 3, 2017.

(51) Int. Cl.

| | |
|---|---|
| ***G09G 3/20*** | (2006.01) |
| *G09G 3/3208* | (2016.01) |
| *G09G 3/36* | (2006.01) |

(52) U.S. Cl.

CPC ..... *G09G 3/2096* (2013.01); *G09G 3/3208* (2013.01); *G09G 3/36* (2013.01); *G09G 2310/027* (2013.01); *G09G 2310/08* (2013.01); *G09G 2320/0233* (2013.01); *G09G 2320/043* (2013.01); *G09G 2340/0435* (2013.01); *G09G 2360/12* (2013.01)

(58) Field of Classification Search

CPC ..... G09G 2310/00–08; G09G 2230/00; G09G 2320/0626; G09G 3/2096; G09G 3/2092; G09G 3/3208; G09G 3/36; G09G 5/006; G09G 5/008; G09G 2320/0233; G09G 2320/043; G09G 2340/0435; G09G 2360/12

USPC ..... 345/100, 94

See application file for complete search history.

(56) References Cited

U.S. PATENT DOCUMENTS

| | | | | |
|---|---|---|---|---|
| 8,102,470 | B2 | 1/2012 | Musunuri et al. | |
| 2002/0140662 | A1 * | 10/2002 | Igarashi ..... | G09G 5/005 345/98 |

(Continued)

*Primary Examiner* — Amr A Awad
*Assistant Examiner* — Aaron Midkiff
(74) *Attorney, Agent, or Firm* — Fletcher Yoder P.C.

(57) ABSTRACT

Systems and methods for improving perceived image quality of an electronic display communicatively coupled to an image data source that outputs a synchronization control signal, which indicates when an image frame is expected to stop being written, based on a source clock signal. The electronic display includes a display pixel row, a display driver, and a timing controller. The timing controller determines a target scan time to be used to write the image frame to the display pixel row and instructs the display driver to write the image frame to the display pixel row based on the target scan time and a display block signal, in which the timing controller instructs the display driver to continue writing the image frame to display pixel row after the electronic display receives the synchronization control signal when the synchronization control signal is received before the target scan time is reached.

20 Claims, 7 Drawing Sheets

(56) References Cited

U.S. PATENT DOCUMENTS

| | | | | |
|---|---|---|---|---|
| 2003/0038766 | A1* | 2/2003 | Lee | G09G 3/3648 345/87 |
| 2003/0132905 | A1* | 7/2003 | Lee | G09G 3/3611 345/89 |
| 2010/0097366 | A1* | 4/2010 | Kitayama | G09G 3/3614 345/213 |
| 2011/0032231 | A1* | 2/2011 | Maruyama | G09G 3/2096 345/208 |
| 2012/0013588 | A1* | 1/2012 | Chung | G09G 3/3266 345/211 |
| 2014/0198138 | A1* | 7/2014 | Nambi | G09G 3/36 345/690 |
| 2015/0348509 | A1 | 12/2015 | Verbeure et al. | |
| 2017/0264860 | A1 | 9/2017 | Shiohara | |

* cited by examiner

DISPLAY SCAN TIME COMPENSATION SYSTEMS AND METHODS

CROSS-REFERENCE TO RELATED APPLICATIONS

This application is a Non-Provisional Application claiming priority to U.S. Provisional Patent Application No. 62/500,930, entitled "DISPLAY SCAN TIME COMPENSATION SYSTEMS AND METHODS," filed May 3, 2017, which is herein incorporated by reference in its entirety for all purposes.

BACKGROUND

The present disclosure relates generally to electronic displays and, more particularly, to operational timing of an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use electronic displays to provide visual representations of information by displaying one or more image frames. Such electronic devices may include computers, mobile phones, portable media devices, tablets, televisions, virtual-reality headsets, and vehicle dashboards, among many others. Generally, an electronic display may display an image frame by controlling light emission (e.g., perceived or actual luminance) from its display pixels based at least in part on corresponding image data, which indicates target luminance of the display pixels for displaying the image frame. In some instances, the electronic display may receive image data from an image data source, such as a display pipeline, a graphics processing unit (GPU), or the like.

Additionally, in some instances, luminance of a display pixel may vary based at least in part on electrical energy stored in the display pixel. Thus, to control light emission from a display pixel, the electronic display may supply a data (e.g., analog electrical) signal to the display pixel based at least in part on corresponding image data and instruct the display pixel to store electrical energy based at least in part on the data signal, thereby writing the display pixel. Generally, electrical energy stored in a display pixel may change at less than an instantaneous rate, for example, due to charging or discharging a storage component (e.g., pixel electrode or storage capacitor) in the display pixel. In fact, in some instances, reducing writing duration (e.g., scan time) of a display pixel may affect perceived luminance, for example, due to stored electrical energy not yet reaching a steady state expected to result in the target luminance of the display pixel.

Furthermore, in some instances, operational timing of the electronic display may be controlled based at least in part on a display clock while operational timing of the image data source is controlled based at least in part on a source clock. Generally, the source clock and the display clock may be relatively synchronized. However, in some instances, timing variations affecting synchronization between the display clock and the source clock may occur, for example, due to aging and/or environmental conditions. Although generally small, timing variations may accumulate over time. In fact, when the display clock lags behind the source clock, the scan time of one or more display pixels may be reduced to a point that causes perceived luminance to differ from target luminance. When perceivable, such a mismatch may result in a visual artifact that affects perceived image quality of an electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving perceived image quality of an electronic display. To display an image frame, the electronic display may sequentially write the image frame to display pixel rows. In some embodiments, perceived image quality of the electronic display may be affected by the scan time used to write the image frame to the display pixel rows when the scan time varies. For example, a shortened scan time on certain frames may increase the likelihood of luminance variations, which may be perceived as visual artifacts when the image frame is displayed.

To facilitate improving perceived image quality, in some embodiments, the electronic display may determine a target scan time that is expected to be sufficient to write the image frame to the display pixel rows. For example, the electronic display may determine a target scan time that allows data signals enough time to adjust the amount of electrical energy stored in each of the display pixels to a steady-state level that corresponds to a target luminance. Since operational timing is based on the source clock and the display clock, in some embodiments, the electronic display may determine the target scan time in number of clock cycles.

Although ideally synchronized, in some instances, timing variations between the internal clock used in the electronic display (sometimes referred to as the display clock) and the clock associated with the source of the image data (sometimes referred to as the source clock) may result, for example, due to process variation, aging, and/or environmental conditions. Generally, timing variations between the display clock and the source clock resulting from writing one display pixel row may be small and, thus, not result in perceivable luminance variations. However, timing variations between the display clock and the source clock may accumulate over the writing of multiple display pixel rows and, thus, more likely to result in perceivable luminance variations as the duration since last synchronization (e.g., receipt of a synchronization control signal) increases.

Since the likelihood of perceivable visual artifacts increases when the scan time shortens, in some embodiments, the electronic display may continue writing a current image frame even after receiving a synchronization control signal associated with a directly subsequent image frame. In other words, when the display clock is lagging behind the source clock, the electronic display may introduce a synchronization delay by continuing to write each remaining display pixel row with its target scan time even after the synchronization control signal is received. In this manner, the actual scan time of each remaining display pixel rows (e.g., last display pixel row) may be closer to its target scan time and/or the actual scan time of adjacent display pixel rows, thereby reducing likelihood producing perceivable visual artifacts in the remaining rows.

To further improve perceived image quality, the electronic display may attempt to re-synchronize the display clock and the source clock, for example, to reduce likelihood of timing variations propagating across multiple image frames. To facilitate re-synchronization, in some embodiments, an electronic display may account (e.g., compensate) for an introduced synchronization delay during writing of a directly subsequent image frame. In particular, the electronic display may adjust target scan time used to write the directly subsequent image frame to one or more display pixel rows. For example, the electronic display may account for synchronization delay resulting from writing an image frame by distributing the synchronization delay across scan time of one or more display pixel rows used to write a directly subsequent image frame.

Additionally, to facilitate re-synchronization, in some embodiments, the electronic display may continue writing the last display pixel row until a subsequent synchronization control signal is received. In this manner, the electronic display may re-synchronize the display clock and the source clock upon receiving the subsequent synchronization control signal and, thus, before displaying a directly subsequent image frame.

BRIEF DESCRIPTION OF THE DRAWINGS

Various aspects of this disclosure may be better understood upon reading the following detailed description and upon reference to the drawings in which.

DETAILED DESCRIPTION

Figure 1:
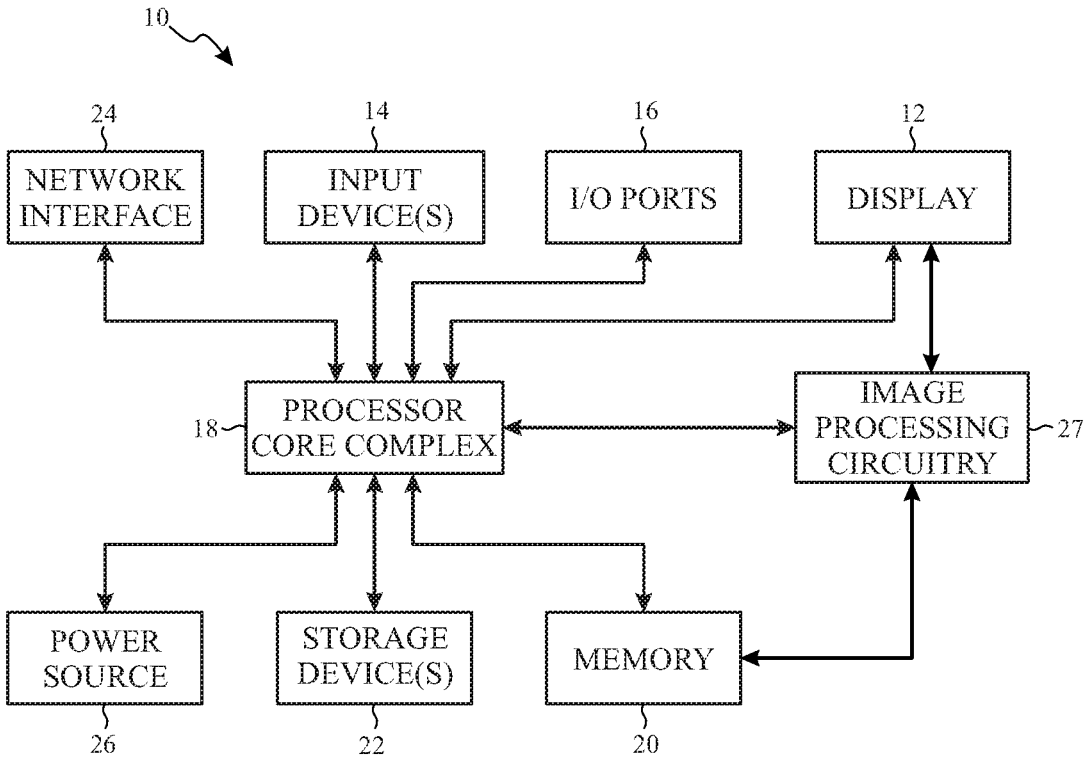
FIG. 1 is a block diagram of an electronic device used to display image frames, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure generally relates to electronic displays, which may be used to present visual representations of information, for example, in one or more image frames. Generally, an electronic display may display an image frame by controlling light emission and, thus, perceived (e.g., actual) luminance of its display pixel based at least in part on corresponding image data. In some electronic displays, light emission from a display pixel may vary based at least in part on electrical energy stored in the display pixel. For example, in a liquid crystal display (LCD), electrical energy may be stored in the pixel electrode of a display pixel to produce an electric field between the pixel electrode and a common electrode, which controls orientation of liquid crystals and, thus, light emission from the display pixel. Additionally, in an organic light-emitting diode (OLED) display, electrical energy may be stored in a storage capacitor of a display pixel to control electrical power (e.g., current) supplied to a self-emissive component (e.g., OLED) and, thus, light emission from the display pixel.

In some instances, image data may digitally indicate target luminance of display pixels for displaying an image frame on an electronic display. Since based on stored electrical energy, the electronic display may write a display pixel by supplying an analog electrical (e.g., data) signal based at least in part on corresponding image data to the display pixel and instructing the display pixel to adjust electrical energy stored in its storage component (e.g., pixel electrode or storage capacitor) based at least in part the analog electrical signal. For example, to write an LCD display pixel, a data driver may output a data (e.g., source) signal and a scan driver may output a scan (e.g., gate) signal, which instructs the display pixel to supply the data signal to its pixel electrode. Additionally, to write an OLED display pixel, a data driver may output a data signal and a scan driver may output a scan control signal, which instructs the display pixel to supply the data signal to its storage capacitor.

To facilitate controlling operation, display pixels in an electronic display may be organized in an array of rows and columns. For example, each row of display pixels may be communicatively coupled to the scan driver via a scan (e.g., gate) line, thereby enabling each display pixel in a row to receive a scan control signal via a corresponding scan line. Additionally, each column of display pixels may be communicatively coupled to data driver via a data line. In other words, one data line may be used to supply data signals to display pixels in different rows. While this disclosure refers to display pixels arranged in rows and columns, these terms are not meant to imply a particular fixed horizontal or vertical arrangement. Rather, these terms are meant to distinguish the order in which groups of pixels are written, in which a first group of pixels ("a first row") is written at one time and a second group of pixels ("a second row") is written at another time. Moreover, rows of pixels may or may not have a particular geometry (e.g., rows of pixels may or may not be linear, or rows of pixels may be curved, or rows of pixels may represent groups of pixels in other arrangements). Moreover, different rows may or may not have the same number of display pixels as other rows.

To display an image frame, the electronic display may coordinate writing (e.g., scanning) of the image frame to its display pixel rows. In some instances, the electronic display may sequentially write its display pixel rows. For example, to display a first image frame, the electronic display may write the first image frame to a first (e.g., top) display pixel row, followed by a second display pixel row, followed by a third display pixel row, and so on until the last (e.g., bottom) display pixel row is written. To display a second image frame directly after the first image frame, the electronic display may again write the first display pixel row, followed by the second display pixel row, followed by the third display pixel row, and so on until the last display pixel row is written.

Generally, an image frame may have a target display duration and/or refresh rate. To facilitate achieving the target display duration, in addition to image data, an image data source may output synchronization control signals to an electronic display. In some instances, a synchronization control signal may indicate when the electronic display is expected to stop writing a current image frame and/or when the electronic display is expected to start writing a next image frame. For example, the electronic display may begin writing the first image frame to the first display pixel row as soon as the electronic display receives a first synchronization control signal and begin writing the second image frame to the first display pixel row as soon as the electronic display receives a second synchronization control signal.

In some instances, operational timing of the image data source may be controlled based on a source clock (e.g., oscillator). In other words, the image data source may output synchronization control signals based at least in part on a source clock (e.g., timing) signal generated by the source clock. On the other hand, operational timing of the electronic display may be controlled based on a display clock. In other words, the electronic display may write its display pixel row based at least in part on a display clock (e.g., timing) signal generated by the display clock. Ideally, the source clock and the display clock are synchronized.

However, in some instances, timing variations between the source clock and the display clock may occur, for example, due to process variation, aging, and/or environmental conditions. In some instances, timing variations between the source clock and the display clock may affect perceived image quality of an electronic display. For example, when the display clock lags behind the source clock, the scan (e.g., line) time used to write one or more display pixel rows may be cut short by a synchronization signal received from the image data source. Since adjusting electrical energy stored in a display pixel is generally less than instantaneous, reducing the scan time used to write the display pixel may reduce likelihood that a data signal supplied to the display pixel is able to adjust the stored electrical energy to a steady-state condition, which is expected to result in its target luminance.

In other words, reducing the scan time of a display pixel row may result in perceived luminance of the display pixel row differing from its target luminance. For example, a reduction in the scan time may result in perceived luminance of the display pixel row being higher (e.g., brighter) or lower (e.g., dimmer) than its target luminance. Moreover, a reduction in the scan time may result in perceived luminance of the display pixel row differing from perceived luminance of a directly adjacent display pixel row even when they have relatively similar target luminances. When perceivable, such luminance variations may result in visual artifacts being displayed, thereby affecting perceived image quality of an electronic display.

Accordingly, the present disclosure provides techniques to facilitate improving perceived image quality of an electronic display, for example, by reducing likelihood that scan time of one or more display pixels is reduced to a point that results in perceivable visual artifacts. In some embodiments, to reduce likelihood of perceivable visual artifacts, the electronic display may determine a target scan time expected to be sufficient to write a display pixel row. In other words, the electronic display may determine the target scan time such that data signals are expected to be provided sufficient time to adjust electrical energy stored in each of the display pixels to a steady-state associated with its corresponding target luminance.

Since operational timing is based on the source clock and the display clock, in some embodiments, the electronic display may determine the target scan time in number of clock cycles. For example, when the display clock and the source clock both have an expected frequency of 100 MHz, the electronic display may determine that the target scan time is 500 clock cycles or 5 μs. However, as described above, timing variations may occur that affect synchronization between the display clock and the source clock. For example, when the electronic display successively writes multiple display pixel rows each for 500 display clock cycles, timing variations may result in some display pixel rows having an actual scan time of 501 source clock cycles while other display pixels have an actual scan time of 499 source clock cycles. In other words, in some instances, writing a display pixel row based on a target scan time tracked in display clock cycles may result in the target scan time differing from an actual scan time tracked in source clock cycles due to timing variations between the display clock and the source clock.

Generally, timing variations between the display clock and the source clock resulting from writing one display pixel row may be small and, thus, not result in perceivable luminance variations. However, timing variations between the display clock and the source clock may accumulate over the writing of multiple display pixel rows and, thus, more likely to result in perceivable luminance variations as duration since receipt of a synchronization control signal increases. In other words, timing variations may more likely affect perceived luminance of a last display pixel row. For example, when an electronic display includes 501 display pixel rows and each of the first 500 display pixel rows is written with an actual scan time of 501 source clock cycles, the electronic display may write the last (e.g., 501st) display pixel for a duration of only 250 display clock cycles before receiving a synchronization control signal. Thus, when the electronic display begins writing the next image frame immediately upon receipt of the synchronization control signal, the actual scan time used to write the last display pixel row may only be 250 source clock cycles, which may increase likelihood of causing a perceivable visual artifact in the last display pixel row.

Thus, in some embodiments, the electronic display may continue writing a current image frame even after receiving a synchronization control signal associated with a directly subsequent image frame. In particular, the electronic display may continue attempting to write each remaining display pixel row with its target scan time. For example, instead of writing the next image frame immediately upon receipt of the synchronization control signal, the electronic display may continue writing the last display pixel row based at least in part on its target scan time. As such, the actual scan time of the last display pixel row may be closer to its target scan time and/or the actual scan time of adjacent display pixel rows, thereby reducing likelihood of the last display pixel row displaying a perceivable visual artifact.

In other words, when the display clock is lagging behind the source clock, the electronic display may introduce a synchronization delay to facilitate improving perceived image quality. In some embodiments, an electronic display may include a counter to facilitate tracking duration of a synchronization delay resulting from writing an image frame. For example, the electronic display may increment the counter based on the display clock when a synchronization signal is received before the last display pixel row is written for at least its target scan time. In this manner, the electronic display may determine number of display clock cycles the display clock lags behind the source clock due to writing of an image frame.

To facilitate re-synchronizing the display clock and the source clock, in some embodiments, an electronic display may account (e.g., compensate) for an introduced synchronization delay during writing of a directly subsequent image frame. In particular, the electronic display may adjust target scan time used to write the directly subsequent image frame to one or more display pixel rows. For example, when synchronization delay resulting from writing an image frame is 250 display clock cycles, the electronic display may adjust target scan time for writing the directly subsequent image frame to each of the first 250 display pixel rows from a default value (e.g., 500 display clock cycles) to an adjusted value (e.g., 499 display clock cycles).

In other words, the electronic display may account for synchronization delay resulting from writing an image frame by distributing the synchronization delay across scan time of one or more display pixel rows. In some embodiments, the electronic display may equally distribute the synchronization delay to as many display pixel rows as possible, thereby reducing adjustment made to target scan time and, thus, likelihood that reducing the target scan time of a display pixel row from a default value to an adjusted value results in a perceivable visual artifact. Additionally or alternatively, in some embodiments, the electronic display may distribute the synchronization delay based at least in part on content of the directly subsequent image frame. For example, the electronic display may skew adjustments toward display pixel rows expected to be written with black content since luminance variations are less likely to be perceivable in black content. Furthermore, in some embodiments, the electronic display may distribute the synchronization delay to adjacent display pixel rows, thereby increasing likelihood that the adjacent display pixel rows are written with approximately the same actual scan times.

Since dependent on dynamic factors (e.g., aging and/or environmental conditions), in some instances, timing variations may result in the display clock leading the source clock. For example, when an electronic display includes 501 display pixel rows and each of the first 500 display pixel rows is written with an actual scan time of 499 source clock cycles, the electronic display may receive a subsequent synchronization control signal 750 display clock cycles after beginning to write the last (e.g., 501st) display pixel.

To facilitate re-synchronizing the display clock and the source clock, in some embodiments, the electronic display may continue writing the last display pixel row until a subsequent synchronization control signal is received. For example, even when the last display pixel row has a target scan time of 500 display clock cycles, the electronic display may write the last display pixel row with an actual scan time of 750 display clock cycles. In other words, when a subsequent synchronization control signal is not yet received, the electronic display may continue writing a display pixel row beyond its target scan time.

In this manner, the electronic display may re-synchronize the display clock and the source clock upon receiving the subsequent synchronization control signal and, thus, before displaying a directly subsequent image frame. By re-synchronizing the display clock and the source clock, the electronic display may reduce likelihood of timing variations accumulating over multiple image frames and, thus, likelihood of timing variations resulting in subsequent image frames being displayed with perceivable visual artifacts. In other words, the techniques of the present disclosure may facilitate improving perceived image quality of an electronic display by 1) introducing a synchronization delay when timing variations result in a display clock lagging behind a source clock, 2) compensating for the synchronization delay in a directly subsequent image frame to facilitate re-synchronization, and 3) extending scan time of a display pixel row when timing variations result in the display clock lagging behind the source clock to facilitate re-synchronization.

To help illustrate, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

In the depicted embodiment, the electronic device 10 includes the electronic display 12, input devices 14, input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. In some embodiments, the local memory 20 and/or the main memory storage device 22 may be tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and the like.

In some embodiments, the processor core complex 18 may execute instruction stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

As depicted, the processor core complex 18 is also operably coupled with the network interface 24. Using the network interface 24, the electronic device 10 may be communicatively coupled to a network and/or other electronic devices. For example, the network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

Additionally, as depicted, the processor core complex 18 is operably coupled to the power source 26. In some embodiments, the power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

Furthermore, as depicted, the processor core complex 18 is operably coupled with I/O ports 16 and the input devices 14. In some embodiments, the I/O ports 16 may enable the electronic device 10 to interface with various other electronic devices, for example, to transmit and/or receive image data. Additionally, in some embodiments, the input devices 14 may enable a user to interact with the electronic device 10. For example, the input devices 14 may include buttons, keyboards, mice, trackpads, and/or the like. Additionally or alternatively, the electronic display 12 may include touch sensing components that enable user inputs to the electronic device 10 by detecting occurrence and/or position of an object touching its screen (e.g., surface of the electronic display 12).

In addition to enabling user inputs, the electronic display 12 may facilitate providing visual representations of information by displaying images (e.g., in one or more image frames). For example, the electronic display 12 may display a graphical user interface (GUI) of an operating system, an application interface, text, a still image, and/or video content. To facilitate displaying images, the electronic display 12 may include a display panel with one or more display pixels.

As described above, the electronic display 12 may display an image frame by controlling luminance of its display pixels based at least in part on corresponding image data (e.g., image pixel image data and/or display pixel image data). In some embodiments, the image data may be received from another electronic device, for example, via the network interface 24 and/or the I/O ports 16. Additionally or alternatively, the image data may be generated by the processor core complex 18 and/or the image processing circuitry 27.

Figure 2:
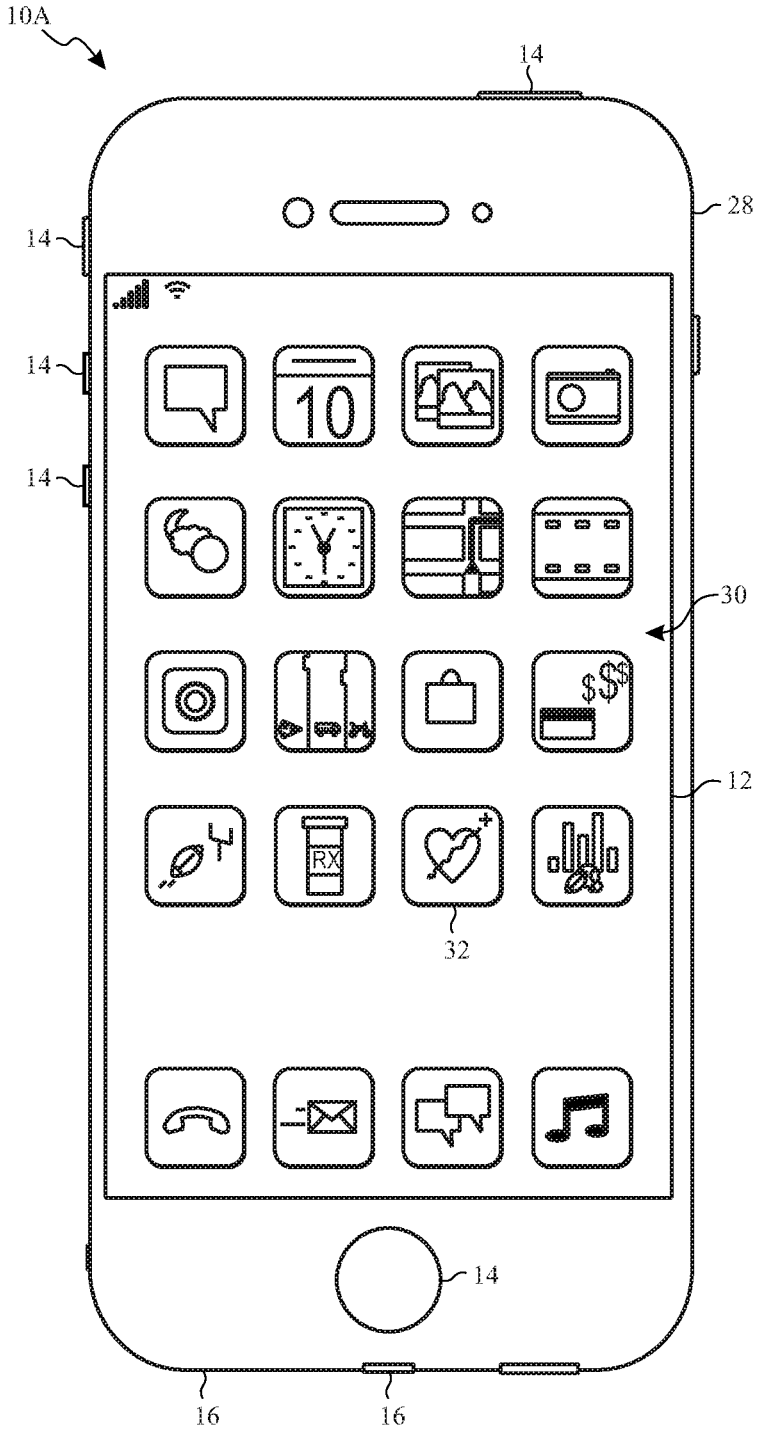
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
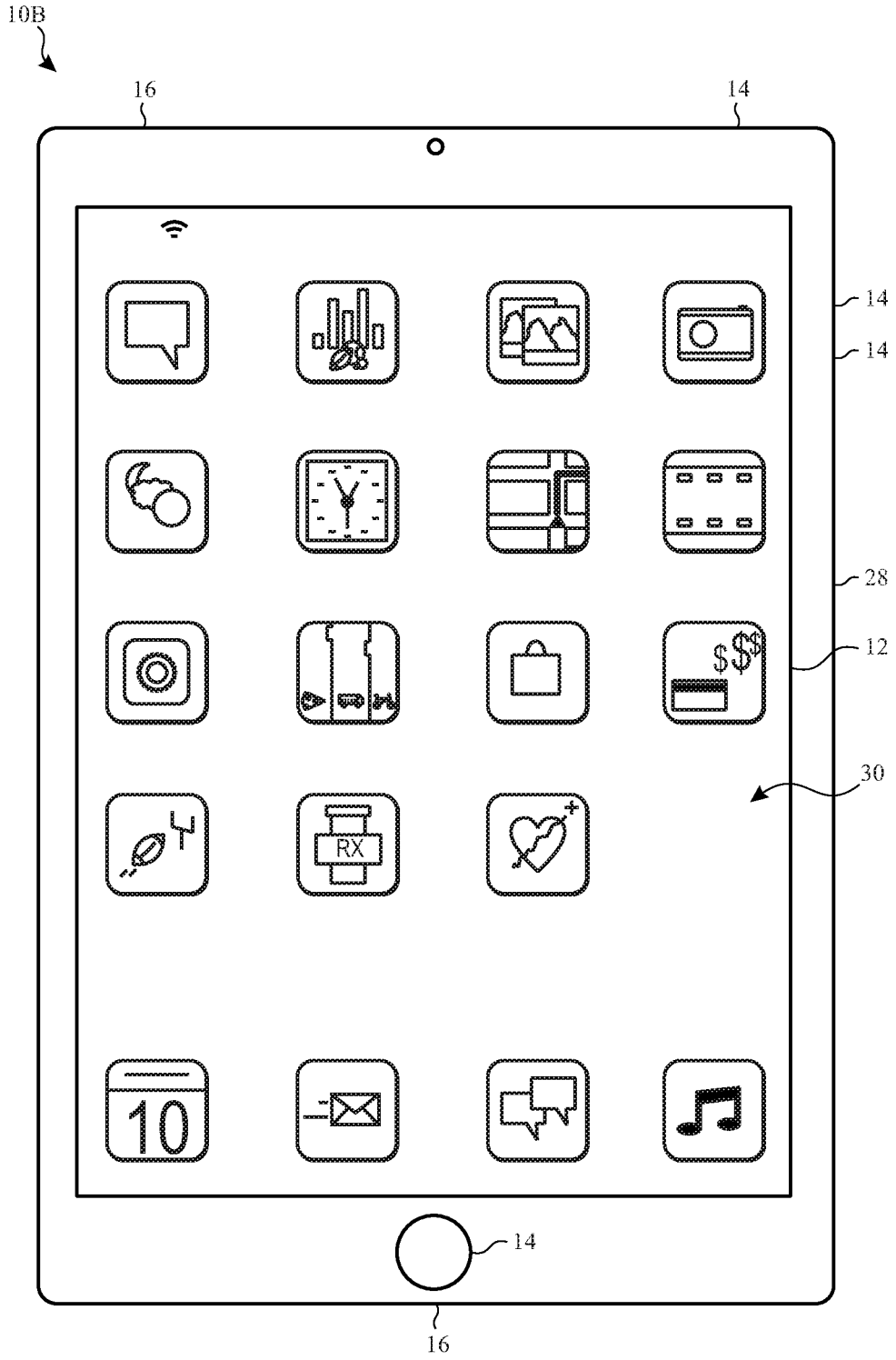
FIG. 3 is an example of the electronic device of FIG. 1, in accordance with an embodiment.
Figure 4:
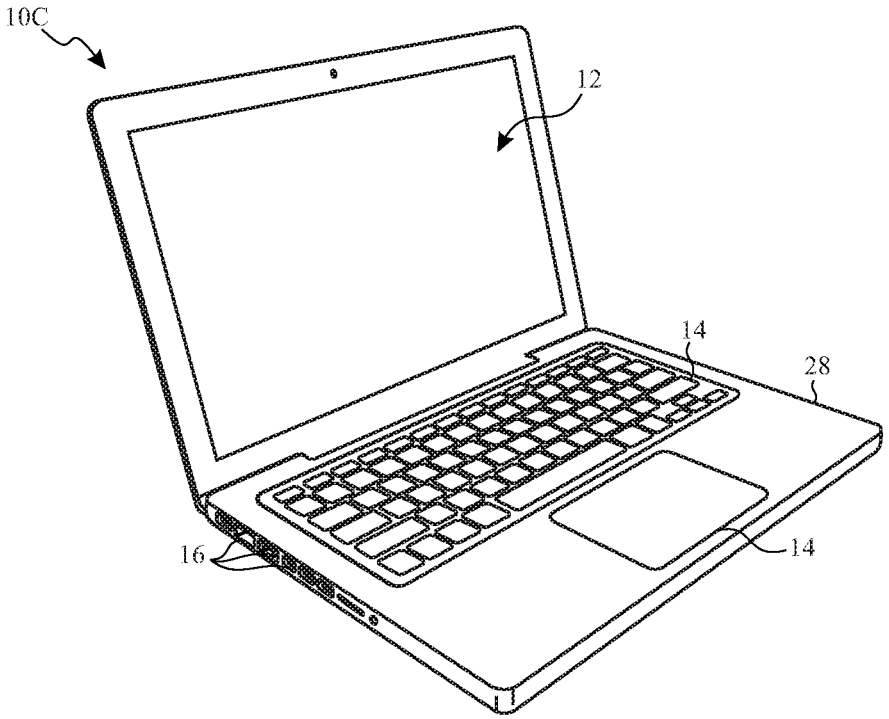
FIG. 4 is an example of the electronic device of FIG. 1, in accordance with an embodiment.
Figure 5:
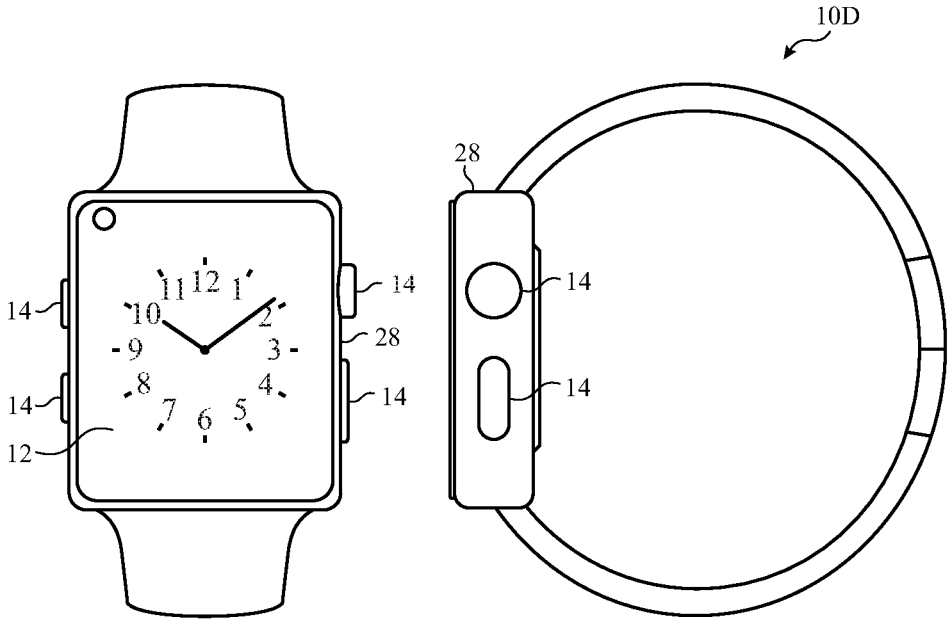
FIG. 5 is an example of the electronic device of FIG. 1, in accordance with an embodiment.
Figure 6:
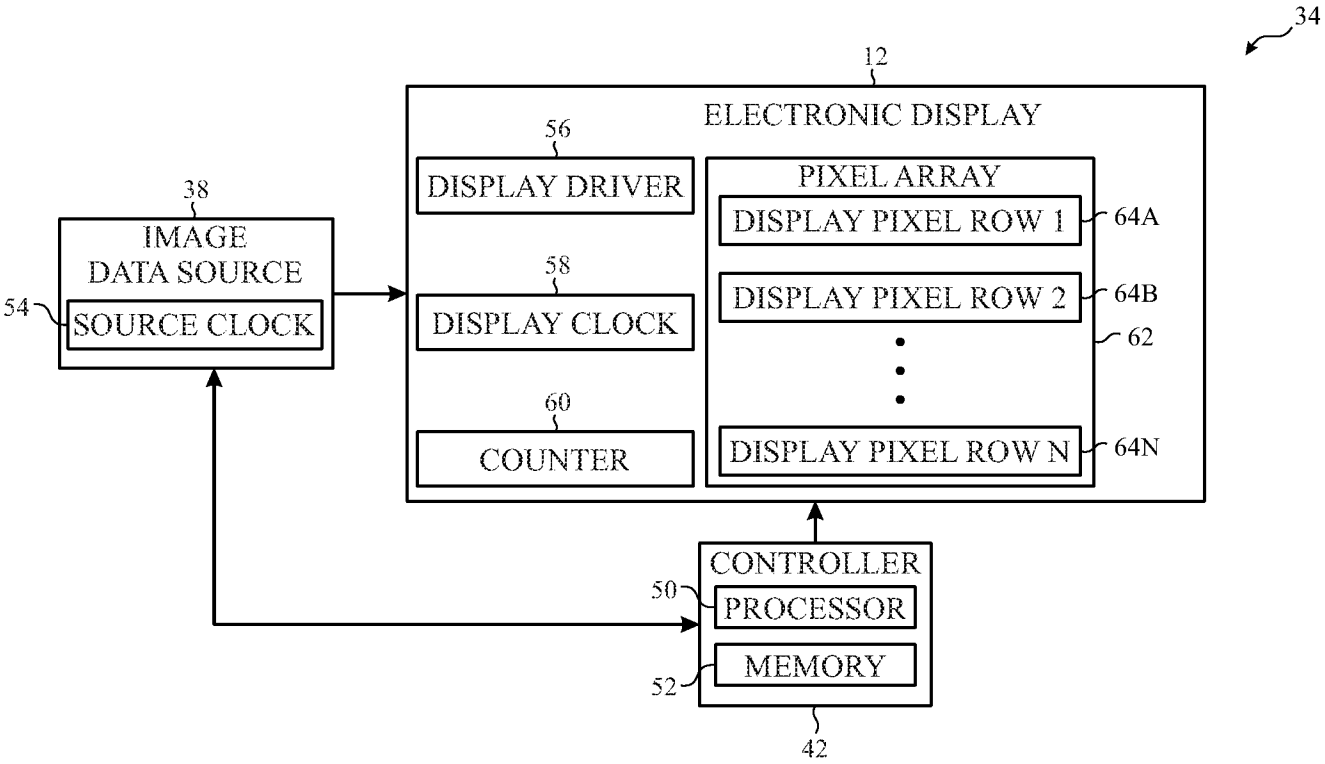
FIG. 6 is a block diagram of an image data source and an electronic display in the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

As described above, the electronic display 12 may display image frames based at least in part on received image data. To help illustrate, a portion 34 of the electronic device 10 including the electronic display 12 is shown in FIG. 5. As depicted, the portion 34 of the electronic device 10 also includes an image data source 38 and a controller 42. In some embodiments, the controller 42 may control operation of the electronic display 12 and/or the image data source 38. To facilitate controlling operation, the controller 42 may include a controller processor 50 and controller memory 52. In some embodiments, the controller processor 50 may execute instructions stored in the controller memory 52. Thus, in some embodiments, the controller processor 50 may be included in the processor core complex 18, the image processing circuitry 27, a timing controller (TCON) in the electronic display 12, a separate processing module, or any combination thereof. Additionally, in some embodiments, the controller memory 52 may be included in the local memory 20, the main memory storage device 22, a separate tangible, non-transitory, computer readable medium, or any combination thereof.

In the depicted embodiment, the electronic display 12 is communicatively coupled to the image data source 38. In this manner, the electronic display 12 may receive image data and/or synchronization control signals from the image data source 38. As described above, the image data source may operate to generate image data, which indicates target luminance of display pixels for displaying one or more image frames, and synchronization control signals, which indicate target display duration of one or more image frames. In some embodiments, the image data source 38 may be included in the processor core complex 18, the image processing circuitry 27, or a combination thereof.

Additionally, in some embodiments, the image data source 38 may operate based at least in part on a source clock 54. In some embodiments, the source clock 54 may be an oscillator with a fixed target frequency (e.g., 100 MHz) and, thus, output a source clock signal. Based at least in part on the source clock signal, the image data source 38 may control output timing of image data and/or synchronization control signals to the electronic display.

As described above, based at least in part on received image data and synchronization control signals, the electronic display 12 may display one or more image frames. To facilitate displaying an image frame, as depicted, the electronic display 12 includes a display driver 56, a display clock 58, a counter 60, and display pixels organized in a pixel array 62 with N display pixel rows 64. For example, the pixel array 62 may include 501 display pixel rows 64, 648 display pixel rows 64, 720 display pixel rows 64, 768 display pixel rows 64, 900 display pixel rows 64, 1080 display pixel rows 64, 1440 display pixel rows 64, or any other suitable number of display pixel rows 64.

In some embodiments, the display driver 56 may write an image frame to the pixel array 62. Thus, in some embodiments, the display driver 56 may include a data driver communicatively coupled to each display pixel in the pixel array 62 via one or more data (e.g., source or drain) lines. For example, the data driver may be communicatively coupled to each display pixel in a first display pixel column via a first data line, each display pixel in a second display pixel column via a second data line, and so on. In this manner, the display driver 56 (e.g., data driver) may output data (e.g., analog electrical) signals generated based on target luminance of the display pixels via corresponding data lines.

Additionally, in some embodiments, the display driver 56 may include a scan driver communicatively coupled to each display pixel in the pixel array 62 via one or more scan (e.g., gate) lines. For example, the scan driver may be communicatively coupled to each display pixel in a first display pixel row 64A via a first scan line, each display pixel in a second display pixel row 64B via a second scan line, and so on. In this manner, the display driver 56 (e.g., scan driver) may output scan control signals used to control writing of the display pixels via corresponding scan lines.

Furthermore, in some embodiments, the electronic display 12 may operate based at least in part on the display clock 58. In some embodiments, the display clock 58 may be an oscillator with a fixed target frequency (e.g., 100 MHz) and, thus, output a display clock signal. Based at least in part on the source clock signal, the electronic display 12 may control output timing of data signals and/or scan control signals from the display driver 56 to the pixel array 62. In some embodiments, the display clock 58 and the source clock 54 may have the same target frequency to facilitate synchronizing operation of the image data source 38 and the electronic display 12.

Nevertheless, in some instances, timing variations affecting synchronization of the display clock 58 and the source clock 54 may occur, for example, due to aging of the image data source 38, aging of the electronic display 12, environmental conditions of image data source 38, and/or environmental conditions of the electronic display 12. In particular, aging and/or environmental conditions (e.g., temperature, atmospheric pressure, and/or humidity) may affect frequency of the source clock 54 and/or the display clock 58, thereby potentially resulting in timing variations between the display clock 58 and the source clock 54. As described above, such timing variations may accumulate over time and, in some instances, may result in perceivable visual artifacts, for example, when timing variations cause scan time of a display pixel row 64 to be cut short due to receipt of a synchronization control signal.

To reduce likelihood of producing a perceivable visual artifact, as will be described in more detail below, the electronic display 12 may introduce a synchronization delay when over the course of writing an image frame the display clock 58 cumulatively lags behind the source clock 54. Additionally, the electronic display 12 may attempt to re-synchronize the display clock 58 and the source clock 54 by accounting for the synchronization delay while writing a directly subsequent image frame. In other words, to facilitate re-synchronization, the electronic display 12 may determine duration of the synchronization delay (e.g., duration between receipt of a subsequent synchronization control signal and completing writing of a last display pixel row 64N).

In some embodiments, the electronic display 12 may use the counter 60 to track duration of an introduced synchronization delay. For example, the counter 60 may begin to increment based on the display clock 58 when the electronic display 12 receives a synchronization control signal associated with a subsequent image frame, but has not yet completed writing of a current image frame. Additionally, the counter 60 may continue incrementing based on the display clock 58 until the electronic display 12 completes writing of the current image frame. As such, the counter 60 may indicate duration of an introduced synchronization delay in display clock cycles.

In this manner, the electronic display 12 may operate to successively display multiple image frames. To help illustrate, one embodiment of a process 66 for operating an electronic display 12 is described in FIG. 7. Generally, the process 66 includes receiving image data corresponding with an image frame (process block 68), determining target scan time of each display pixel row (process block 70), and displaying the image frame based at least in part on the target scan times (process block 72). In some embodiments, the process 66 may be implemented based on circuit connections formed in the electronic display 12. Additionally or alternatively, in some embodiments, the process 66 may be implemented by executing instructions stored in a tangible non-transitory computer-readable medium, such as the controller memory 52, using processing circuitry, such as the controller processor 50.

As described above, the electronic display 12 may receive image data from the image data source 38 (process block 68). In some embodiments, image data corresponding with an image frame may digitally indicate target luminance of each display pixel for displaying the image frame on the electronic display 12. Additionally, in some embodiments, image data may indicate target luminance of specific color components at a display pixel. For example, image data corresponding with a display pixel in a red-green-blue (RGB) format may indicate target luminance of a red component, target luminance of a green component, and target luminance of a blue component at the display pixel.

Additionally, the controller 42 may instruct the electronic display 12 to determine a target scan time associated with each display pixel row 64 (process block 70). In other words, the electronic display 12 may determine target duration to be used to write the image frame to each of the display pixel rows 64. To reduce likelihood of producing perceivable visual artifact, the target scan duration of each display pixel row 64 may be approximately equal. However, as described above, the electronic display 12 may adjust target scan time of one or more display pixel row 64 to facilitate compensating for timing variations between the source clock 54 and the display clock 58.

Figure 8:
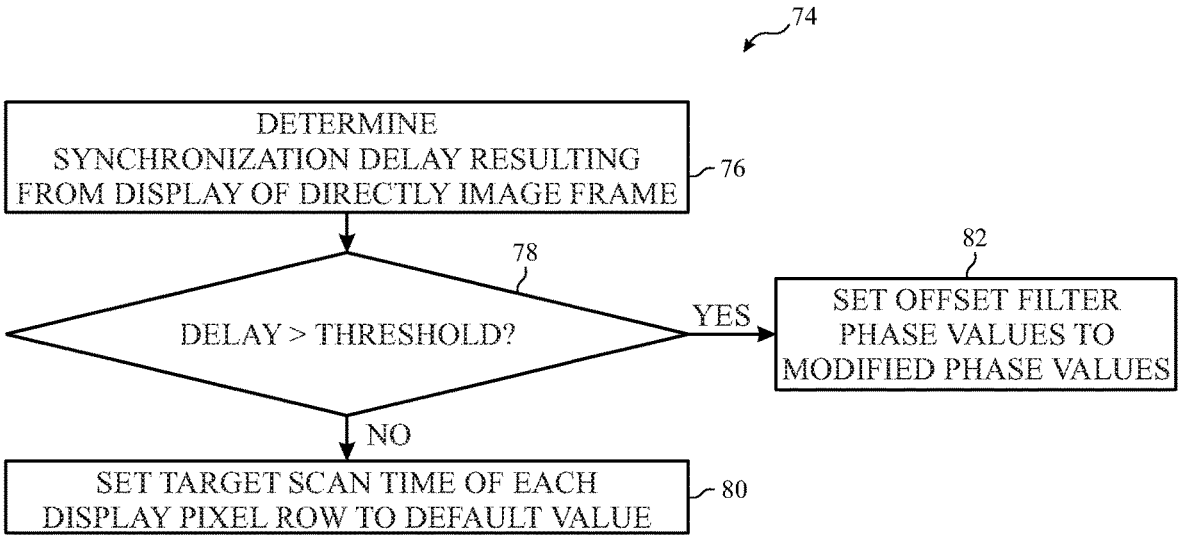
FIG. 8 is a flow diagram of a process for determining target scan duration of a display pixel row, in accordance with an embodiment.

To help illustrate, one embodiment of a process 74 for determining target scan time of display pixel rows 64 is described in FIG. 8. Generally, the process 74 includes determining synchronization delay resulting from display of a directly previous image frame (process block 76), determining whether the synchronization delay is greater than a delay threshold (decision block 78), setting target scan time of each display pixel row to a default value when the synchronization delay is not greater than the delay threshold (process block 80), and setting target scan time of one or more display pixel rows to an adjusted value when the synchronization delay is greater than the delay threshold (process block 82). In some embodiments, the process 74 may be implemented based on circuit connections formed in the electronic display 12. Additionally or alternatively, in some embodiments, the process 74 may be implemented by executing instructions stored in a tangible non-transitory computer-readable medium, such as the controller memory 52, using processing circuitry, such as the controller processor 50.

Accordingly, in some embodiments, the controller 42 may instruct the electronic display 12 to determine duration of any synchronization delay introduced during writing of the directly previous image frame (process block 76). As described above, when a synchronization delay is introduced, the counter 60 may track duration of the synchronization delay in display clock cycles. Thus, based at least in part on value of the counter 60, the electronic display 12 may determine whether a synchronization delay is introduced and/or number of display clock cycles in an introduce synchronization delay.

Additionally, the controller 42 may instruct the electronic display 12 to determine whether the synchronization delay is greater than a delay threshold (decision block 78). Since synchronization delay may be indicated in display clock cycles, in some embodiments, the delay threshold may be indicated in display clock cycles. For example, the delay threshold may be zero display clock cycles. In such embodiments, the electronic display 12 may determine that a synchronization delay is not introduced during display of the directly previous image frame.

Accordingly, when the synchronization delay is not greater than the delay threshold (e.g., zero clock cycles), the electronic display 12 may determine that the display clock 58 and the source clock 54 are expected to be synchronized at the beginning of the image frame and, thus, set target scan time of each display pixel row to a default value (process block 80). In some embodiments, the default value may be predetermined and stored, for example, in controller memory 52. Additionally or alternatively, the electronic display 12 may determine the default value based at least in part on expected display duration of a current image frame (e.g., based on actual display duration of one or more previous image frames). For example, the electronic display 12 may determine the default value by dividing the expected display duration by number of display pixel rows 64.

On the other hand, when the synchronization delay is greater than the delay threshold (e.g., zero clock cycles), the electronic display may determine that a synchronization delay is introduced during display of the directly previous image frame and, thus, set target scan time of one or more display pixel rows 64 to adjusted values to compensate (e.g., offset) for the synchronization delay (process block 82). To reduce likelihood of adjusting target scan time resulting in perceivable visual artifacts, in some embodiments, the electronic display 12 may distribute the synchronization delay across multiple display pixel rows 64. Additionally or alternatively, the electronic display 12 may distribute the synchronization delay across adjacent display pixel rows 64, thereby reducing likelihood that actual scan time of the adjacent display pixel rows results in perceivable visual artifacts. For example, when the synchronization delay is 250 display clock cycles, the electronic display 12 may reduce target scan time of the first 250 display pixel rows 64 from the base value (e.g., 500 display clock cycles) by one display clock cycle.

Furthermore, in some embodiments, the electronic display 12 may distribute the synchronization delay based at least in part on content of the image frame. In particular, likelihood of adjusting scan time resulting in perceivable visual artifacts may vary with content. For example, luminance variations may be less likely to be perceivable in black content. Thus, to reduce likelihood of producing perceivable visual artifacts, the electronic display 12 may skew distribution of the synchronization delay toward display pixel rows 64 that are expected to display such content. For example, the electronic display 12 distribute the synchronization delay only to display pixel rows 64 expected to display predominantly black content. In this manner, the electronic display 12 may determine target scan time of each display pixel row 64 for writing an image frame to the pixel array 62.

Figure 7:
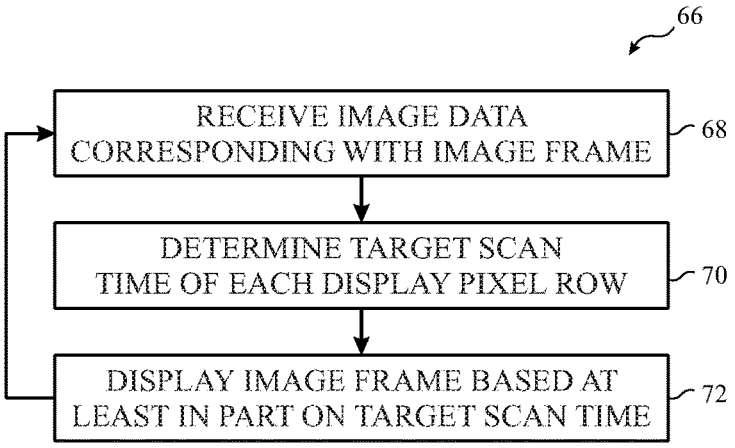
FIG. 7 is a flow diagram of a process for operating the electronic display of FIG. 6, in accordance with an embodiment.
Figure 9:
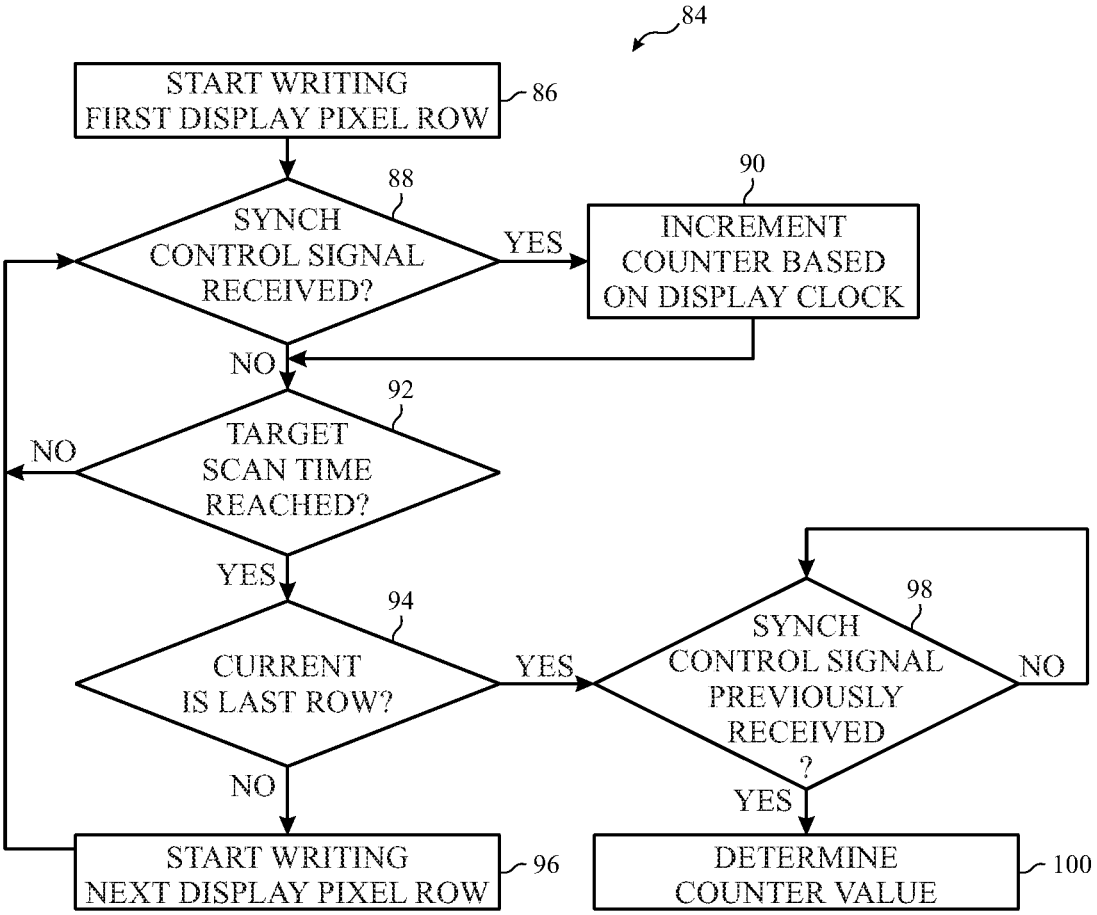
FIG. 9 is a flow diagram of a process for displaying an image frame on the electronic display of FIG. 6, in accordance with an embodiment.

Returning to the process 66 of FIG. 7, the controller 42 may instruct the electronic display 12 to display the image frame based at least in part on the target scan times (process block 72). To help illustrate, one embodiment of a process 84 for displaying an image frame is described in FIG. 9. Generally, the process 84 includes starting to write a first display pixel row (process block 86), determining whether a synchronization control signal have been received (decision block 88), incrementing a counter based on a display clock when the synchronization control signal has been received (process block 90), determining whether a target scan time has been reached (decision block 92), determining whether a current display pixel row is the last display pixel row (decision block 94), and starting to write a next display pixel row when the current display pixel row is not the last display pixel row (process block 96). Additionally, when the current display pixel row is the last display pixel row, the process 84 includes determining whether a synchronization control signal was previously received (decision block 98) and determining the counter value when the synchronization control signal was previously received (process block 100). In some embodiments, the process 84 may be implemented based on circuit connections formed in the electronic display 12. Additionally or alternatively, in some embodiments, the process 84 may be implemented by executing instructions stored in a tangible non-transitory computer-readable medium, such as the controller memory 52, using processing circuitry, such as the controller processor 50.

Accordingly, in some embodiments, the controller 42 may instruct the electronic display 12 to begin writing an image frame to the first display pixel row 64A (process block 86). As described above, to facilitate writing a display pixel row 64, the display driver 56 (e.g., data driver) may output a data (e.g., analog electrical) signals generated based on corresponding image data to each data line coupled to a display pixel in the display pixel row 64. Additionally, the display driver 56 (e.g., scan driver) may output a scan control signal to a gate line coupled to along the display pixel row 64. In some embodiments, the scan control signal may instruct each display pixel to adjust its stored electrical energy based at least in part on a received data signal. For example, the scan control signal may activate a transistor in each display pixel of the display pixel row, thereby causing each display pixel to electrically connect a data line to its storage component (e.g., pixel electrode or storage capacitor).

While writing the first display pixel row 64A, the controller 42 may instruct the electronic display 12 to determine whether a synchronization control signal associated with a subsequent image frame has been received (decision block 88). Additionally, when the synchronization control signal associated with the subsequent image frame has been received while writing a display pixel row 64, the controller 42 may instruct the electronic display to increment the counter 60 based at least in part on the display clock 58 (process block 90). In some embodiments, the counter 60 may increment once per display clock cycle. Additionally, in some embodiments, the counter 60 may begin incrementing as soon as the synchronization control signal associated with the subsequent image frame has been received and continue incrementing until the electronic display completes writing the image frame to the last display pixel row 64N or begins writing the subsequent image frame to the first display pixel row 64A.

Since writing a display pixel is generally less than instantaneous, the controller 42 may instruct the electronic display 12 to continue writing a current display pixel row 64 until its associated target scan time is reached (decision block 92). After reaching the target scan time, the controller 42 may instruct the electronic display 12 to determine whether the current display pixel row 64 is the last display pixel row 64N (decision block 94) and instruct the electronic display 12 to start writing the next display pixel row 64 when the current display pixel row 64 is not the last display pixel row 64N (process block 96). In this manner, the electronic display 12 may successively write the image frame to each display pixel row 64 based at least in part on its associated target scan time.

When the electronic display 12 has reached the target scan time of the last display pixel row 64N, the controller 42 may instruct the electronic display 12 to determine whether the synchronization control signal associated with the subsequent image frame was previously received (decision block 98). In other words, the electronic display 12 may determine whether the synchronization control signal was received while writing the image frame. Moreover, when the synchronization control signal is not yet received, the electronic display 12 may determine that display clock 58 is leading the source clock 54 and, thus, continue writing the last display pixel row 64N. In this manner, the electronic display 12 may facilitate re-synchronizing the display clock 58 and the source clock 54 at the beginning of the subsequent image frame, thereby reducing likelihood of timing variations propagating over multiple image frames.

On the other hand, when the synchronization control was previously received, the electronic display 12 may determine that display clock 58 is lagging behind the source clock 54. Accordingly, the electronic display 12 may determine that a synchronization delay was introduced by continuing to write one or more display pixel rows 64 even after the synchronization control signal was received. As described above, the electronic display 12 may attempt to compensate for the synchronization delay during writing of a directly subsequent image frame, for example, by adjusting target scan time used to write the directly subsequent image frame to one or more display pixel rows 64.

To facilitate adjusting one or more target scan time used to write the directly subsequent image frame, the controller 42 may instruct the electronic display 12 to determine value of the counter 60 when the synchronization control associated with the subsequent image frame was previously received (process block 100). As described above, in some embodiments, the counter value may indicate duration of the synchronization delay in display clock cycles. To facilitate re-synchronizing the display clock 58 and the source clock 54, the electronic display 12 may adjust target scan time associated with one or more display pixel rows 64 to compensate (e.g., offset) for the synchronization delay while writing the directly subsequent image frame, thereby reducing likelihood of timing variations propagating over multiple image frames.

Figure 10:
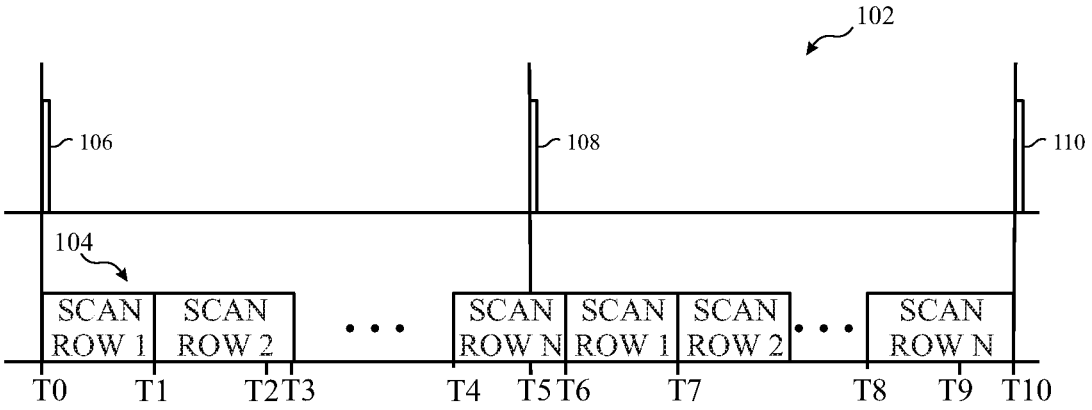
FIG. 10 is a timing diagram describing example operation of the image data source and the electronic display of FIG. 6 for displaying a first image frame and a second image frame, in accordance with an embodiment.

To further illustrate the techniques described in the present disclosure, FIG. 10 depicts timing diagrams describing example operation of the image data source 38 and the electronic display. In particular, a first timing diagram 102 describes operational timing of the image data source 38 between T0 and T10. Additionally a second timing diagram 104 describes operational timing of the electronic display 12 between T0 and T10.

As depicted in the first timing diagram 102, the image data source 38 supplies the electronic display 12 a first synchronization control signal 106 at T0, a second synchronization control signal 108 at T5, and a third synchronization control signal 110 at T10. In particular, the first synchronization control signal 106 indicates that the image data source 38 expects the electronic display 12 to begin writing a first image frame at T0. Additionally, the second synchronization control signal 108 indicates that the image data source 38 expects the electronic display 12 to complete writing the first image frame and begin writing a second image frame at T5. Furthermore, the third synchronization control signal 110 indicates that the image data source 38 expects the electronic display 12 to complete writing the second image frame at T10.

Thus, as depicted in the second timing diagram 104, the electronic display 12 begins writing the first image frame to the first display pixel row 64A at T0. In this example, the target scan time of the first display pixel row 64A is the duration between T0 and T1. Thus, based on its target scan time, the electronic display 12 continues writing the first display pixel row 64A until T1, thereby resulting in actual scan time of the first display pixel row 64A matching its target scan time.

Additionally, as depicted in the second timing diagram 104, the electronic display 12 begins writing the first image frame to the second display pixel row 64B at T1. In this example, the target scan time of the second display pixel row 64B is the duration between T1 and T2. However, instead of stopping exactly at T2, the electronic display 12 continues writing the second display pixel row 64B until T3, thereby resulting in actual scan time of the second display pixel row 64B differing from its target scan time. As described above, this mismatch may have resulted due to a timing variation between the display clock 58 and the source clock 54 during writing of the second display pixel row 64B.

Furthermore, as depicted in the second timing diagram 104, the electronic display 12 continues sequentially writing the first image frame to the display pixel rows 64 after T3 and begin writing the first image frame to the last display pixel row 64N at T4. In this example, the target scan time of the last display pixel row 64N is the duration between T4 and T6. However, due to accumulated timing variations, the electronic display 12 receives the second synchronization control signal 108 at T5. However, instead of immediately beginning to write the second image frame at T5, the electronic display 12 continues writing the first image frame to the last display pixel row 64N until T6, thereby introducing a synchronization delay between T5 and T6 to reduce likelihood of the first image frame including a perceivable visual artifact in the last display pixel row 64N. As described above, in some embodiments, duration of the synchronization delay may be tracked by the counter 60 and indicated by the counter value at T6.

Due the introduced synchronization delay, as depicted in the second timing diagram 104, the electronic display 12 begins writing the second image frame to the first display pixel row 64A at T6. To account for the synchronization delay, the electronic display 12 may adjust target scan time of one or more of the display pixel row 64. Based at least in part on its target scan time, the electronic display 12 continues writing first display pixel row 64A until T7.

In a similar manner, as depicted in the second timing diagram 104, the electronic display 12 continues sequentially writing the second image frame to the second display pixel row 64B and so on. In particular, the electronic display 12 begins writing the second image frame to the last display pixel row 64N at T8. In this example, the target scan time for writing the second image frame to the last display pixel row 64B is the duration between T8 and T9. Thus, at T9, the electronic display 12 may determine that the target scan time of the last display pixel row 64B has been reached, but the third synchronization control signal 110 has not yet been received.

Accordingly, as depicted in the second timing diagram 104, the electronic display 12 continues writing the last display pixel row 64N until the third synchronization control signal 110 is received at T10. As described above, continuing to write the last display pixel row 64N even after reaching its target scan time may facilitate synchronizing the display clock 58 and the source clock 54. For example, with regard to FIG. 10, writing the second image frame to the last display pixel row 40N until T10 may facilitate re-synchronizing the display clock 58 and the source clock 54 before beginning to write a third image frame at T10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an image data source configured to generate a synchronization control signal that indicates when a first image frame is expected to stop being written based at least in part on a source clock signal; and an electronic display communicatively coupled to the image data source, wherein the electronic display comprises:

a first display pixel row comprising a first plurality of display pixels;

a display driver coupled to each of the first plurality of display pixels; and a timing controller configured to:

generate a display clock signal;

determine a first target scan time corresponding to a first time duration to be used to write a portion of the first image frame to the first display pixel row; and instruct the display driver to write the portion of the first image frame to the first display pixel row based at least in part on the first target scan time and the display clock signal;

when the electronic display receives the synchronization control signal before the first target scan time is reached, instruct the display driver to continue writing the first image frame after the electronic display receives the synchronization control signal; and when the first display pixel row is disposed on the electronic display as a last physically arranged display pixel row and when the first target scan time is reached before the electronic display receives the synchronization control signal, instruct the display driver to continue to write the portion of the first image frame to the first display pixel row.

2. The electronic device of claim 1, wherein the timing controller is configured to:

instruct the display driver to begin writing the portion of the first image frame to the first display pixel row at a first time, wherein the electronic display receives the synchronization control signal at a second time after the first time; and instruct the display driver to continue writing the portion of the first image frame to the first display pixel row until a third time after the second time when a second duration of time between the first time and the second time is less than the first time duration.

3. The electronic device of claim 2, wherein the timing controller is configured to:

determine a synchronization delay that indicates a third duration of time between the second time and the third time; and instruct the display driver to begin writing a second image frame at a fourth time, wherein the fourth time corresponds to the third duration of time after the second time, and wherein the second image frame is to be displayed directly after the first image frame.

4. The electronic device of claim 1, wherein:

the electronic display comprises a second display pixel row, wherein the second display pixel row comprises a second plurality of display pixels;

the display driver is communicatively coupled to each of the second plurality of display pixels; and the timing controller is configured to:

determine a synchronization delay that indicates a second duration of time that the display driver used to continue to write the first display pixel row after the electronic display received the synchronization control signal;

determine a second target scan time to be used to write a first portion of a second image frame to the second display pixel row at least in part by increasing a default scan time duration based at least in part on the second duration of time indicated by the synchronization delay, wherein the second image frame is to be displayed directly after the first image frame using both the first display pixel row and the second display pixel row; and instruct the display driver to write the first portion of the second image frame to the second display pixel row based at least in part on the second target scan time and the display clock signal.

5. The electronic device of claim 4, wherein:

the electronic display comprises a third display pixel row directly adjacent to the second display pixel row, wherein the third display pixel row comprises a third plurality of display pixels;

the display driver is communicatively coupled to each of the third plurality of display pixels; and the timing controller is configured to:

determine a third target scan time to be used to write a second portion of the second image frame to the third display pixel row based at least in part on the second duration of time indicated by the synchronization delay, wherein the third target scan time is equal to the second target scan time; and instruct the display driver to write the second portion of the second image frame to the third display pixel row after writing the first portion of the second image frame to the second display pixel row based at least in part on the third target scan time and the display clock signal.

6. The electronic device of claim 4, wherein the timing controller is configured to:

determine a third target scan time to be used to write a second portion of the second image frame to the first display pixel row, wherein the third target scan time is different from the second target scan time to be used to write the first portion of the second image frame to the second display pixel row; and instruct the display driver to write the second portion of the second image frame to the first display pixel row after writing the first portion of the second image frame to the second display pixel row based at least in part on the third target scan time and the display clock signal.

7. The electronic device of claim 1, wherein:

the electronic display comprises a plurality of display pixel rows including the first display pixel row;

the display driver is communicatively coupled to each of the plurality of display pixel rows; and the timing controller is configured to:

determine a synchronization delay;

determine a second target scan time to be used to write respective portions of a second image frame to each of the first plurality of display pixels based at least in part on the synchronization delay, wherein the second image frame is to be displayed directly after the first image frame; and instruct the display driver to sequentially write the respective portions of the second image frame to each of the plurality of display pixel rows based at least in part on the second target scan time and the display clock signal.

8. The electronic display of claim 7, wherein the timing controller is configured to determine the second target scan time at least in part by equally distributing the synchronization delay across each start time associated with writing the second image frame to the plurality of display pixel rows.

9. The electronic display of claim 7, wherein the timing controller is configured to:

determine content of the second image frame based at least in part on corresponding image data; and determine the second target scan time at least in part by distributing the synchronization delay across each start time associated with writing the respective portions of the second image frame to one or more of the plurality of display pixel rows based at least in part on the content of the second image frame.

10. The electronic device of claim 1, wherein:

the electronic display comprises:

a gate line coupled to each of the first plurality of display pixels; and a plurality of data lines, wherein each of the plurality of data lines is coupled to a corresponding one of the first plurality of display pixels; and the display driver comprises:

a data driver coupled to each of the plurality of data lines, wherein the data driver is configured to output a data signal to each of the plurality of data lines based at least in part on a target luminance of the corresponding one of the first plurality of display pixels in the first image frame; and a scan driver coupled to the gate line, wherein the scan driver is configured to output a scan control signal to the gate line to write the portion of the first image frame to the first display pixel row by instructing each of the first plurality of display pixels to supply the data signal from a corresponding one of the plurality of data lines to a storage component.

11. The electronic device of claim 10, wherein the image data source is configured to output image data that indicates a target luminance of each of the first plurality of display pixels in the first image frame.

12. The electronic device of claim 1, wherein:

the timing controller comprises a display clock configured to generate the display clock signal;

the image data source comprises a source clock configured to generate the source clock signal;

the source clock comprises a first oscillator; wherein the display clock comprises a second oscillator;

a first target frequency of the first oscillator and a second target frequency of the second oscillator are equal to facilitate synchronizing operation of the image data source and the electronic display; and timing variations between the source clock and the display clock occur due to aging of the image data source, aging of the electronic display, environmental conditions of the image data source, environmental conditions of the electronic display, or any combination thereof.

13. The electronic device of claim 1, wherein the electronic device comprises a portable phone, a media player, a personal data organizer, a handheld game platform, a tablet device, a computer, or any combination thereof.

14. A method for operating an electronic display, comprising:

outputting a first scan control signal to a first scan line communicatively coupled to a first display pixel in coordination with a first data signal output to the first display pixel, wherein the first scan control signal writes a portion of a first image frame to the first display pixel, and wherein a first target scan time corresponds to a first time duration to be used to write the portion of the first image frame to a first display pixel row comprising the first display pixel;

receiving a synchronization control signal that indicates the electronic display is expected to begin writing a second image frame, wherein the second image frame is to be displayed on the electronic display directly after the first image frame; and continuing to output the first scan control signal to the first scan line in response to determining that the first scan line is a last scan row of the electronic display and that the synchronization control signal is received before reaching the first target scan time.

15. The method of claim 14, comprising:

determining a synchronization delay based at least in part on duration of time that a display driver continues outputting the first scan control signal after the synchronization control signal is received;

outputting a second data signal from the display driver to the first display pixel after the synchronization delay, wherein the second data signal is generated based at least in part on second image data that indicates a target luminance of a second display pixel in the second image frame; and outputting a second scan control signal from the display driver to a second scan line communicatively coupled to the second display pixel in coordination with the second data signal, wherein the second scan control signal writes a portion of the second image frame to the second display pixel.

16. The method of claim 15, comprising:

outputting a third data signal from the display driver to the second display pixel before outputting the first data signal, wherein the third data signal is generated based at least in part on third image data that indicates the target luminance of the second display pixel in the first image frame; and outputting a third scan control signal from the display driver to the second scan line in coordination with the third data signal, wherein the third scan control signal writes another portion of the first image frame to the second display pixel before the first scan control signal writes the portion of the first image frame to the first display pixel.

17. The method of claim 14, wherein continuing to output the first scan control signal to the first scan line in response to the determining that the first target scan time is reached before the electronic display receives the synchronization control signal is configured to facilitate a re-synchronizing operation of the electronic display with an image data source that outputs the synchronization control signal before writing the second image frame.

18. A tangible, non-transitory, computer-readable medium that stores instructions executable by one or more processors of an electronic device, wherein the instructions comprise instructions to:

instruct, using the one or more processors, a display driver in an electronic display to output a first data signal to a first data line communicatively coupled to a first display pixel in a last display pixel row of the electronic display, wherein the first data signal is generated based at least in part on first image data that indicates a target luminance of the first display pixel in a first image frame;

instruct, using the one or more processors, the display driver to output a first scan control signal to a first scan line communicatively coupled to the first display pixel, wherein the first scan line is a last scan row of the electronic display, wherein the first scan control signal writes the first image frame to at least the first display pixel by instructing the first display pixel to electrically connect the first data line and a first storage component in the first display pixel;

instruct, using the one or more processors, the display driver to introduce a synchronization delay by continuing to output scan control signals to the first scan line after the electronic display receives a synchronization control signal when the synchronization control signal is received before a first target scan time is reached, wherein the synchronization control signal indicates that the electronic display is expected to stop writing the first image frame and begin writing a second image frame; and when the first target scan time is reached before the electronic display receives the synchronization control signal, instruct, using the one or more processors, the display driver to continue writing to the last scan row until the electronic display receives the synchronization control signal.

19. The tangible, non-transitory, computer-readable medium of claim 18, wherein the instructions comprise instructions to:

instruct, using the one or more processors, the display driver to output a second data signal to the first data line for a duration of time indicated by the synchronization delay after the electronic display receives the synchronization control signal, wherein the first data line is communicatively coupled to a second display pixel in a first display pixel row of the electronic display and the second data signal is generated based at least in part on second image data that indicates a target luminance of the second display pixel in the second image frame; and instruct, using the one or more processors, the display driver to output a second scan control signal to a second scan line for the duration of time indicated by the synchronization delay after the electronic display receives the synchronization control signal, wherein the second scan line is communicatively coupled to the second display pixel and the second scan control signal writes the second image frame to the second display pixel by instructing the second display pixel to electrically connect the first data line and a second storage component in the second display pixel.

20. The tangible, non-transitory, computer-readable medium of claim 18, wherein the instructions comprise instructions to:

instruct, using the one or more processors, the display driver to output a second data signal to the first data line, wherein the first data line is communicatively coupled to a second display pixel in a first display pixel row of the electronic display and the second data signal is generated based at least in part on second image data that indicates the target luminance of the second display pixel in the second image frame; and instruct, using the one or more processors, the display driver to output a second scan control signal to a second scan line communicatively coupled to the second display pixel, wherein the second scan control signal writes the second image frame to the second display pixel by instructing the second display pixel to electrically connect the first data line and a second storage component in the second display pixel.

* * * * *